US007390776B2

(12) United States Patent
Tsumori et al.

(10) Patent No.: US 7,390,776 B2
(45) Date of Patent: Jun. 24, 2008

(54) LIQUID DETERGENT BUILDER AND LIQUID DETERGENT CONTAINING THE SAME

(75) Inventors: Takahiro Tsumori, Nishinomiya (JP); Atsuro Yoneda, Toyonaka (JP); Akiko Hemmi, Osaka (JP); Shigeru Yamaguchi, Yao (JP)

(73) Assignee: Nippon Shokubai Co., Ltd., Osaka (JP)

( * ) Notice: Subject to any disclaimer, the term of this patent is extended or adjusted under 35 U.S.C. 154(b) by 327 days.

(21) Appl. No.: 10/493,108

(22) PCT Filed: Sep. 11, 2003

(86) PCT No.: PCT/JP03/11658

§ 371 (c)(1),
(2), (4) Date: Apr. 20, 2004

(87) PCT Pub. No.: WO2004/024856

PCT Pub. Date: Mar. 25, 2004

(65) Prior Publication Data

US 2005/0003993 A1 Jan. 6, 2005

(30) Foreign Application Priority Data

Sep. 13, 2002 (JP) ..... 2002-268758
Dec. 27, 2002 (JP) ..... 2002-382516

(51) Int. Cl.
*C11D 1/00* (2006.01)
*C11D 3/37* (2006.01)

(52) U.S. Cl. ..... 510/361; 510/434; 510/476; 510/477; 510/483; 510/488; 510/492; 510/533

(58) Field of Classification Search ..... 510/361, 510/434, 476, 477, 488, 492, 533, 483
See application file for complete search history.

(56) References Cited

U.S. PATENT DOCUMENTS 6,034,045 A 3/2000 Carr et al.

FOREIGN PATENT DOCUMENTS

| | | | | |
|---|---|---|---|---|
| EP | 0 308 221 | A | | 3/1989 |
| EP | 0 335 404 | A | | 10/1989 |
| EP | 0 381 261 | A | | 8/1990 |
| EP | 0 414 285 | A | | 2/1991 |
| EP | 0 442 191 | A | | 8/1991 |
| EP | 0 523 950 | A | | 1/1993 |
| EP | 0 768 370 | A | | 4/1997 |
| EP | 0 851 022 | A2 | | 7/1998 |
| EP | 0 942 015 | A2 | | 9/1999 |
| EP | 942015 | | * | 9/1999 |
| EP | 0 985 690 | A2 | | 3/2000 |
| EP | 1 101 778 | A1 | | 5/2001 |
| EP | 1101778 | | * | 5/2001 |
| EP | 1 170 312 | A2 | | 1/2002 |
| JP | 2002-12627 | A | | 1/2002 |

OTHER PUBLICATIONS

European Search Report dated Feb. 9, 2005.
Partial International Search Report Feb. 9, 2005.

* cited by examiner

*Primary Examiner*—Brian P Mruk
(74) *Attorney, Agent, or Firm*—Sughrue Mion, PLLC

(57) ABSTRACT

A liquid detergent builder which is highly compatible with a surfactant and gives transparent liquid detergents having extremely excellent detergency, a liquid detergent containing the builder, and a liquid detergent containing an acrylic acid-based polymer (salt) having excellent clay dispersibility and good compatibility with a surfactant. The liquid detergent builder comprises an acrylic acid/maleic acid-based copolymer (salt), wherein the acrylic acid/maleic acid-based copolymer (salt) contains maleic acid (salt) in an amount of 5-90 mol % per mole of the sum of acrylic acid (salt) and maleic acid (salt), and a product (MA×Mw) of a weight average molecular weight (Mw) of the copolymer (salt) and a proportion (MA (mol %)) of the maleic acid (salt) in the copolymer (salt) is 450,000 or less.

22 Claims, No Drawings

LIQUID DETERGENT BUILDER AND LIQUID DETERGENT CONTAINING THE SAME

TECHNICAL FIELD

The present invention relates to a novel liquid detergent builder and a liquid detergent comprising the same.

BACKGROUND ART

Water-soluble polymers are preferable for use in a detergent builder, and for example, unsaturated carboxylic acid-based (co)polymers such as acrylic acid, methacrylic acid, α-hydroxyacrylic acid, itaconic acid, maleic acid, fumaric acid, crotonic acid or citraconic acid have conventionally used as the water-soluble polymer.

In recent years, improvement and research in such (co) polymers are actively made for the purpose of improving performances in various uses of detergent builders.

In particular, where a detergent builder based on an unsaturated carboxylic acid-based polymer or a modified product thereof as described in JP-A 2002-12627 is used as a powder detergent, its performance could be exhibited in a relatively high level.

However, a detergent builder comprising the above-described conventional unsaturated carboxylic acid-based (co) polymer had disadvantages that the (co)polymer has very poor compatibility with a surfactant, and as a result, such is not suitable for use as a liquid detergent.

Further, citric acid has been used as a chelating agent in a liquid detergent. However, citric acid does not have clay (dirt) dispersibility, and therefore, a dispersant has been desired to improve detergency.

Polyacrylic acid (salt) is used as a dispersant in a liquid detergent, but this is not compatible with a liquid detergent containing a surfactant in high concentration.

DISCLOSURE OF THE INVENTION

Accordingly, one object of the present invention is to provide a novel liquid detergent builder that has very excellent compatibility with a surfactant, and provides a liquid detergent having high transparency and also having very excellent detergency when used in the liquid detergent.

Another object of the present invention is to provide a novel liquid detergent comprising the liquid detergent builder.

Still another object of the present invention is to provide a liquid detergent comprising an acrylic acid-based polymer (salt) having excellent clay dispersiblity and compatibility with a surfactant.

The present inventors made extensive investigations to overcome the above-described problems in the art. As a result, they have noted an acrylic acid/maleic acid-based copolymer (salt) or an acrylic acid/3-allyloxy-2-hydroxy-1-propanesulfonic acid (hereinafter referred to as "HAPS" for simplicity)-based copolymer (salt), having specific composition and molecular weight, and have found that the above-described conventional problems that could not be overcome by a builder comprising conventional unsaturated carboxylic acid-based (co)polymer can be overcome by using the above-specified acrylic acid/maleic acid-based copolymer (salt) or acrylic acid/HAPS-based copolymer (salt) as a liquid detergent builder. Further, the problems can also be overcome by a liquid detergent comprising an acrylic acid-based polymer (salt) having a specific molecular weight in specific concentration and a surfactant in high concentration. The present invention has been completed based on those findings.

A first embodiment of the present invention is to provide a liquid detergent builder comprising an acrylic acid/maleic acid-based copolymer (salt), wherein the acrylic acid/maleic acid-based copolymer (salt) contains maleic acid (salt) in an amount of 5-90 mol % per mole of the sum of acrylic acid (salt) and maleic acid (salt), and a product (MA×Mw) of a weight average molecular weight (Mw) of the copolymer (salt) and a proportion (MA (mol %)) of the maleic acid (salt) in the copolymer (salt) is 450,000 or less.

A second embodiment of the present invention is to provide a liquid detergent comprising the liquid detergent builder of the first embodiment.

A third embodiment of the present invention is to provide a liquid detergent builder comprising an acrylic acid/HAPS-based copolymer (salt), wherein the acrylic acid/HAPS-based copolymer (salt) contains HAPS (salt) in an amount of 1-50 mol % per mole of the sum of acrylic acid (salt) and HAPS (salt), and has a weight average molecular weight of 100,000 or less.

A fourth embodiment of the present invention is to provide a liquid detergent comprising the liquid detergent builder of the third embodiment.

A fifth embodiment of the present invention is to provide a liquid detergent comprising 0.5 mass % or more of a liquid detergent builder which comprises an acrylic acid-based polymer (salt) having a weight average molecular weight Mw of 4,500 or less.

BEST MODE FOR CARRYING OUT THE INVENTION

The liquid detergent builder according to the present invention comprises an acrylic acid/maleic acid-based copolymer (salt) (hereinafter referred to as "copolymer 1") or an acrylic acid/HAPS-based copolymer (salt) (hereinafter referred to as "copolymer 2") as the essential component. The liquid detergent builder may consist of the copolymer 1 or 2, or may further comprise other polymers.

The liquid detergent according to the present invention comprises an acrylic acid-based polymer (salt) (hereinafter sometimes referred to as "copolymer for the invention").

Copolymer 1:

The copolymer 1 is an acrylic acid/maleic acid-based copolymer (salt), wherein maleic acid (salt) is contained in an amount of 5-90 mol % per mole of the sum of acrylic acid (salt) and maleic acid (salt), and a product (MA×Mw) of a weight average molecular weight (Mw) of the copolymer (salt) and a proportion (MA (mol %)) of the maleic acid (salt) in the copolymer (salt) is 450,000 or less.

The term "-based" used herein for the acrylic acid/maleic acid-based copolymer (salt) in the copolymer 1 means a copolymer comprising 90 mol % or more of the sum of structural units derived from the respective monomers of maleic acid (salt) and acrylic acid (salt) and 10 mol % or less of structural units derived from other copolymerizable monomers, per mole of the copolymer 1. Preferably, the sum of structural units derived from the respective monomers of maleic acid (salt) and acrylic acid (salt) is 100 mol %.

In other polymers such as the copolymer 2, the term "-based" has the same meaning as above.

In the copolymer 1, an acrylic acid/maleic acid-based copolymer (salt) wherein maleic acid (salt) is contained in an amount of 5-90 mol % per mole of the sum of acrylic acid (salt) and maleic acid (salt) means that at least acrylic acid (salt) and maleic acid (salt) are contained in amounts such that a molar ratio of acrylic acid (salt) unit/maleic acid (salt) unit is 95/5 to 10/90.

The term "(salt)" used herein means that it may be an acid type, a partial salt type, a complete salt type or mixtures of those. Those types are referred to as "(salt)" for simplicity. Examples of the salt include salts of an alkali metal such as sodium or potassium, salts of an alkaline earth metal such as calcium or magnesium, ammonium salts, and salts of organic amine such as monoethanol amine or triethanol amine. Those salts may be used alone or as mixtures of two or more thereof. The preferred form in forming a salt is salts of an alkali metal such as sodium or potassium, and of those, sodium salt is more preferable.

Copolymerizable monomers other than acrylic acid (salt) and maleic acid (salt) used in the copolymer 1 are not particularly limited. Examples of the copolymerizable monomer include methacrylic acid (salt), α-hydroxyacrylic acid (salt), itaconic acid (salt), fumaric acid (salt), crotonic acid (salt), citraconic acid (salt), styrene; styrenesulfonic acid; vinyl acetate; (meth)acrylonitrile; (meth)acrylamide; methyl (meth)acrylate; ethyl (meth)acrylate; butyl (meth)acrylate; 2-ethylhexyl (meth)acrylate; dimethylaminoethyl (meth) acrylate; diethylaminoethyl (meth)acrylate; allyl alcohol; 3-methyl-3-buten-1-ol; 3-methyl-2-buten-1-ol; 2-methyl-3-buten-2-ol; 3-(meth)acryloxy-1,2-dihydroxypropane; 3-(meth)acryloxy-1,2-di(poly)oxyethylene-ether-propane; 3-(meth)acryloxy-1,2-di(poly)oxypropylene-ether-propane; 3-(meth)acryloxy-1,2-dihydroxypropanephosphoric acid or its monovalent metal salt, divalent metal salt, ammonium salt, organic amine salt or mono or diester with C1-4 alkyl; 3-(meth)acryloxy-1,2-dihydroxypropanesulfuric acid or its monovalent metal salt, divalent metal salt, ammonium salt, organic amine salt or ester with C1-4 alkyl; 3-(meth)acryloxy-2-hydroxypropanesulfonic acid or its monovalent metal salt, divalent metal salt, ammonium salt, organic amine salt or ester with C1-4 alkyl; 3-(meth)acryloxy-2-(poly)oxyethylene-ether-propanesulfonic acid or its monovalent metal salt, divalent metal salt, ammonium salt, organic amine salt or ester with C1-4 alkyl; 3-(meth)acryloxy-2-(poly)oxypropylene-ether-propanesulfonic acid or its monovalent metal salt, divalent metal salt, ammonium salt, organic amine salt or ester with C1-4 alkyl; 3-allyloxypropane-1,2-diol; 3-allyloxypropane-1,2-diol phosphate; 3-allyloxypropane-1,2-diol sulfonate; 3-allyloxypropane-1,2-diol sulfate; 3-allyloxy-1,2-di(poly)oxyethylene-ether-propane; 3-allyloxy-1,2-di(poly)oxyethylene-ether-propane phosphate; 3-allyloxy-1,2-di(poly)oxyethylene-ether-propane sulfonate; 3-allyloxy-1,2-di(poly)oxypropylene-ether-propane; 3-allyloxy-1,2-di(poly)oxypropylene-ether-propane phosphate; 3-allyloxy-1,2-di(poly)oxypropylene-ether-propane sulfonate; 6-allyloxyhexane-1,2,3,4,5-pentaol; 6-allyloxyhexane-1,2,3,4,5-pentaol phosphate; 6-allyloxyhexane-1,2,3,4,5-pentaol sulfonate; 6-allyloxyhexane-1,2,3,4,5-penta(poly)oxyethylene-ether-hexane; 6-allyloxyhexane-1,2,3,4,5-penta(poly)oxypropylene-ether-hexane; 3-allyloxy-2-hydroxypropanesulfonic acid or its monovalent metal salt, divalent metal salt, ammonium salt, or organic amine salt or their phosphate or sulfate and their monovalent metal salt, divalent metal salt, ammonium salt or organic amine salt; 3-allyloxy-2-(poly)oxyethylenepropanesulfonic acid or its monovalent metal salt, divalent metal salt, ammonium salt or organic amine salt, or their phosphate or sulfate and their monovalent metal salt, divalent metal salt, ammonium salt, or organic amine salt; 3-allyloxy-2-(poly)oxypropylenepropanesulfonic acid and its monovalent metal salt, divalent metal salt, ammonium salt, or organic amine salt, or their phosphate or sulfate and their monovalent metal salt, divalent metal salt, ammonium salt, or organic amine salt. Polyalkylene glycol-containing monomers can also be used, and examples thereof include polyalkylene glycol (meth)acrylates, allyl alcohol-polyalkylene oxide adducts, and 3-methyl-3-buten-1-ol-alkylene oxide adducts. Polyethylene glycol and polyethylene oxide are preferred for polyalkylene glycol and alkylene oxide, respectively.

Copolymerization method for producing the copolymer 1 is not particularly limited, and conventional methods can be used. Specifically, the method is a polymerization in a solvent such as water, an organic solvent or a mixed solvent of a water-soluble organic solvent and water. Catalyst that can be used in the polymerization is not particularly limited, and examples thereof include persulfates and hydrogen peroxide. A promoter such as hydrogen sulfite or ascorbic acid can also be used together. Further, azo initiators or organic perxodes can also be used, and a promoter such as amine compounds can also be used together. A catalyst system using persulate or peroxide, and ascorbic acid in combination is preferable from the standpoint of proceeding a reaction advantageously. A chain transfer agent such as mercaptoethanol, mercaptopropionic acid or sodium phosphite may also be used together as a controlling agent of molecular weight.

The weigh average molecular weight of the copolymer 1 must be that the product (MA×Mw) is 450,000 or less, preferably 420,000 or less, more preferably 400,000 or less, even more preferably 370,000 or less, and most preferably 350,000 or less. Therefore, the weight average molecular weight is 1,000-90,000, preferably 1,500-70,000, more preferably 2,000-50,000, even more preferably 2,500-30,000, and most preferably 3,000-20,000.

The molar ratio of acrylic acid (salt) unit/maleic acid (salt) unit in the copolymer 1 is 95/5 to 10/90, preferably 90/10 to 15/85, more preferably 85/15 to 20/80, even more preferably 80/20 to 30/70, and most preferably 75/25 to 40/60.

The reason for limiting MA and the product (MA×Mw) in the present invention is to secure a compatibility with a surfactant. Further reason is to secure a calcium ion-binding capacity and a clay dispersibility because the calcium ion-binding capacity increases but the clay dispersibility decreases, as the proportion of the maleic acid (salt) unit increases and the molecular weight increases.

The copolymer 1 has a calcium ion-binding capacity of 280 mg $CaCO_3$/g or more, preferably 290 mg $CaCO_3$/g or more, more preferably 300 mg $CaCO_3$/g or more, even more preferably 310 mg $CaCO_3$/g or more, and most preferably 320 mg $CaCO_3$/g or more.

The copolymer 1 has a clay dispersibility in high hardness water of 0.30 or more, preferably 0.33 or more, even more preferably 0.35 or more, still more preferably 0.38 or more, and most preferably 0.40 or more.

The definition of the calcium ion-binding capacity and the clay dispersibility is shown in the Examples described hereinafter.

High clay dispersibility is preferable in low hardness water. Therefore, the clay dispersibility in low hardness water is 0.40 or more, preferably 0.45 or more, more preferably 0.50 or more, even more preferably 0.55 or more, and most preferably 0.60 or more. Low hardness water used herein means water having a concentration of 50 ppm calculated as $CaCO_3$.

Liquid Detergent Builder 1:

The liquid detergent builder 1 according to the present invention comprises the above-described copolymer 1 as the essential component.

Specifically, the liquid detergent builder 1 may consist of the copolymer 1, or may comprises a mixture of the copolymer 1 and other conventional detergent builders.

The other detergent builder is not particularly limited, and the examples thereof include sodium citrate, sodium tripolyphosphate, sodium pyrophosphate, sodium silicate, Glauber's salt, sodium carbonate, sodium nitrirotriacetate, sodium or potassium ethylenediaminetetraacetate, zeolite, carboxyl derivatives of polysaccharides, and water-soluble polymers.

A water-soluble polymer that may be used in combination is, for example, a water-soluble polycarboxylic acid-based polymer.

Examples of the water-soluble polycarboxylic acid-based polymer include acrylic acid-based polymer (salt), methacrylic acid(-based) polymer (salt), α-hydroxyacrylic acid-based polymer (salt), acrylic acid/sulfonic acid group-containing monomer-based copolymer (salt), methacrylic acid/sulfonic acid group-containing monomer-based copolymer (salt), acrylic acid/hydroxyl group-containing monomer-based copolymer (salt), methacrylic acid/hydroxyl group-containing monomer-based copolymer (salt). Those polymers may be used alone or as mixtures of two or more thereof. The term "polymer (salt)" used herein means that it may be an acid type, a partial salt type, a complete salt type, or mixtures thereof. Those are referred to as "polymer (salt)" for simplicity.

Of those polymers, acrylic acid-based polymer (salt) and acrylic acid/sulfonic acid group-containing monomer-based copolymer (salt) are particularly preferable.

The acrylic acid-based polymer (salt) comprises 90 mol % or more of a structural unit derived from acrylic acid and 10 mol % or less of a structural unit derived from other copolymerizable monomers. Examples of the other copolymerizable monomer include the same monomers as described for the copolymer 1.

The weight average molecular weight of the acrylic acid-based polymer (salt) is not particularly limited, and is generally 1,000-100,000, preferably 1,500-75,000, more preferably 2,000-50,000, even more preferably 3,000-30,000, and most preferably 4,000-20,000.

The acrylic acid-based polymer (salt) has a clay dispersibility in high hardness water of 0.15 or more, preferably 0.25 or more, more preferably 0.35 or more, and most preferably 0.40 or more.

The acrylic acid-based polymer (salt) has a calcium ion-binding capacity of 100 mg $CaCO_3$/g or more, preferably 150 mg $CaCO_3$/g or more, more preferably 200 mg $CaCO_3$/g or more, and most preferably 220 mg $CaCO_3$/g or more.

The acrylic acid-based polymer (salt) can be added to the liquid detergent builder 1 such that a mass ratio of copolymer 1/acrylic acid-based polymer (salt) is 10/90 to 100/0, preferably 20/80 to 100/0, more preferably 30/70 to 100/0, and most preferably 50/50 to 100/0.

The acrylic acid-based polymer (salt) may contain the acrylic acid-based polymer (salt) that is the polymer of the invention.

The content of structural units derived from a sulfonic acid group-containing monomer in the acrylic acid/sulfonic acid group-containing monomer-based copolymer (salt) or methacrylic acid/sulfonic acid group-containing monomer-based copolymer (salt) that can be used in the liquid detergent builder 1 is 5-50 mol %, preferably 6-40 mol %, more preferably 7-30 mol %, and most preferably 8-20 mol %.

Examples of the sulfonic acid group-containing monomer include vinylsulfonic acid (salt), allylsulfonic acid (salt), methallylsulfonic acid (salt), sulfoethyl acrylate, sulfoethyl methacrylate, sulfopropyl acrylate, sulfopropyl methacrylate, 3-allyloxy-2-hydroxyporopanesulfonic acid (salt), styrenesulfonic acid (salt), 2-acrylamido-2-methylpropanesulfonic acid (salt), and 2-hydroxy-3-butenesulfonic acid (salt). Those may be used alone or as mixtures of two or more thereof. Of those, 3-allyloxy-2-hydroxypropanesulfonic acid, 2-acrylamido-2-methylpropanesulfonic acid (salt), sulfoethyl acrylate, sulfoethyl methacrylate and 2-hydroxy-3-butenesulfonic acid (salt) are preferably used.

The weight average molecular weight of the acrylic acid/sulfonic acid group-containing monomer-based copolymer (salt) is not particularly limited, and is generally 1,000-100,000, preferably 1,500-75,000, more preferably 2,000-50,000, even more preferably 3,000-30,000, and most preferably 4,000-20,000. If the weight average molecular weight is outside the range of 1,000-100,000, there is the possibility that the clay dispersibility in high hardness water decreases remarkably, which is not preferable.

The acrylic acid/sulfonic acid group-containing monomer-based copolymer (salt) has a clay dispersibility in high hardness water of 0.30 or more, preferably 0.35 or more, more further preferably 0.40 or more, particularly preferably 0.45 or more, and most preferably 0.50 or more.

The acrylic acid/sulfonic acid group-containing monomer-based copolymer (salt) has a calcium ion-binding capacity of 120 mg $CaCO_3$/g or more, preferably 130 mg $CaCO_3$/g or more, and more preferably 140 mg $CaCO_3$/g or more.

The acrylic acid/sulfonic acid group-containing monomer-based copolymer (salt) can be added to the liquid detergent builder 1 such that a mass ratio of copolymer 1/acrylic acid/sulfonic acid group-containing monomer-based copolymer (salt) is 10/90 to 100/0, preferably 20/80 to 100/0, more preferably 30/70 to 100/0, and most preferably 50/50 to 100/0.

Mixing method is described below in the case of using, for example, the copolymer 1 (hereinafter referred to as "polymer A") and other polymer (hereinafter referred to as "polymer B") as the liquid detergent builder 1.

The mixing method of polymer A and polymer B is not particularly limited, and examples thereof include the following methods. Those mixing methods can also be applied to the case of mixing three kinds or more of polymers.

(1) Polymer A and polymer B are prepared, respectively, and those are then mixed in the desired proportion.
(2) Either of Polymer A or polymer B is first prepared, and while preparing another polymer, the thus-prepared first polymer is added to the another polymer so as to achieve the desired proportion, whereby a mixture is prepared.
(3) Either of Polymer A or polymer B is prepared, and subsequently preparation of another polymer is conducted so as to achieve the desired proportion, whereby a mixture is prepared.

Of the above methods, method (1) is preferable from the standpoints of ease of design of a polymer mixture and quality stability.

The methods (1), (2) and (3) are described in detail below.

Specifically, the method (1) include a solution-solution mixing which involves mixing two polymers in a solution state; a power-powder mixing which involves mixing two polymers in a powder state; and a solution-powder mixing which involves mixing one polymer in a solution state and another polymer in a powder state. In the powder-powder mixing in which the state after mixing is in a powder state, a uniform mixed solution as a whole is obtained by stirring. In the powder-powder mixing in which the state after mixing is in a powder state, two polymers are preferably finely ground powder, and those must be mixed and sufficiently stirred in order to make the mixture uniform as a whole. Where the resulting mixture is not uniform as a whole, viz., mixture components are localized, the localized portion may not exhibit the specified function.

In this method, polymer A and polymer B may previously be prepared. In such a case, the respective preparation method is not particularly limited as described before. Preferable method is a uniform polymerization by stirring in an aqueous solvent. Powering method in using two or either of polymers in a powder state is not also particularly limited, and powdering may be conducted by the conventional methods. The term "powder state" used herein is used in a broad meaning, and includes all of powder sate, granule state, pellet state, paste state, gel state and the like.

Uniform mixture as a whole is obtained in a solution state or a powder state by the method as described above. Form of the mixture may be made the state according to the purpose. For example, a mixture obtained in a solution state may be converted to a powder state, or a mixture obtained in a powder state may be used as a solution state.

The method (2) is described below.

This method is that during preparation of one polymer, another polymer previously prepared is added so as to achieve the desired proportion, whereby a mixture is obtained. The preparation of the polymer is as described before. Addition method of the polymer previously prepared is not particularly limited. The polymer may be added at the initial stage of polymerization, in the course of polymerization or just after polymerization. The polymer may be added in the manner of en bloc introduction, intermittent introduction, continuous introduction, uniform introduction or ununiform introduction. Further, the polymer may be added in a solution state or a powder state. The state of the polymer added may appropriately be selected according to the purpose. However, the embodiment that the polymer previously prepared is added after substantial completion of the polymerization corresponds to the method (1) above.

The method (3) is described below.

This method is that one polymer is prepared and another polymer is then prepared so as to achieve the desired proportion. This method is a modification method of a method of en bloc addition method at the initial stage of the previously prepared polymer during the preparation of one polymer, in the method (2) above. Difference between method (3) and method (2) is that another polymer begins to prepare before completion of the preparation of one polymer. Thus, method (3) has a kind of continuous polymerization element. This continuous polymerization method may be conducted in the same reaction vessel, or may be conducted in at least two reaction vessels continuously.

The liquid detergent builder 1 contains the copolymer 1 in an amount of 10-100 mass %, preferably 20-90 mass %, more preferably 30-80 mass %, and most preferably 40-70 mass %. It should be noted that this proportion is calculated excluding water contained in the liquid detergent builder 1.

The liquid detergent builder may be in a form of powder such as bulk, powder, sol or gel, or in a form of a solution such as an aqueous solution.

When the liquid detergent builder 1 is used as a liquid detergent as described hereinafter, it is very excellent as a builder for a liquid detergent in that the builder has excellent compatibility with a surfactant, thereby forming a highly concentrated liquid detergent. Due to excellent compatibility with a surfactant, when the builder is added to a liquid detergent, the resulting liquid detergent has excellent transparency. This can prevent the problem of separation of a liquid detergent, caused due to turbidity. Further, such an excellent compatibility makes it possible to form a highly concentrated liquid detergent, leading to the improvement of detergency of a liquid detergent.

Copolymer 2:

The copolymer 2 contains 3-allyloxy-2-hydroxy-1-propanesulfonic acid (HAPS) (salt) in an amount of 1-50 mol % per mole of the sum of acrylic acid (salt) and HAPS (salt), and has a weight average molecular weight of 100,000 or less.

The term "-based" in acrylic acid/HAPS-based copolymer (salt) in the copolymer 2 means a copolymer containing 90 mol % or more of the sum of structural units derived from the respective monomers of acrylic acid and HAPS (salt) and 10 mol % or less of structural unit derived from a monomer of other copolymerizable monomer, per mole of the copolymer 2, preferably a copolymer containing 100 mol % of the sum of structural units derived from the respective monomers of acrylic acid and HAPS (salt), per mole of the copolymer 2.

The term "containing HAPS (salt) in an amount of 1-50 mol % per mole of the sum of acrylic acid (salt) and HAPS (salt)" in the copolymer 2 means that at least acrylic acid (salt) and HAPS (salt) are contained such that a molar ratio of acrylic acid (salt) unit/HAPS (salt) unit is 99/1 to 50/50.

Copolymerizable monomers other than acrylic acid (salt) and HAPS (salt) used in the copolymer 2 are not particularly limited, and examples thereof include the same monomers as exemplified for the copolymer 1.

Copolymerization method for producing the copolymer 2 is not particularly limited, and the copolymer 2 can be produced in the same manner as in the copolymer 1.

The copolymer 2 has a weigh average molecular weight Mw of 100,000 or less, preferably 1,500-75,000, more preferably 2,000-50,000, even more preferably 3,000-30,000, and most preferably 4,000-20,000. The molar ratio of acrylic acid (salt)/HAPS (salt) unit in the copolymer 2 is 99/1 to 50/50, preferably 95/5 to 60/40, more preferably 94/6 to 70/30, and most preferably 93/7 to 75/25.

The reason for limiting the composition of acrylic acid/HAPS-based copolymer and Mw in the present invention is to secure a compatibility with a surfactant while satisfying a calcium ion-binding capacity and a clay dispersibility.

The copolymer 2 has a calcium ion-binding capacity of 120 mg $CaCO_3$/g or more, preferably 130 mg $CaCO_3$/g or more, and more preferably 140 mg $CaCO_3$/g or more.

The copolymer 2 has a clay dispersibility in high hardness water of 0.30 or more, preferably 0.35 or more, and more preferably 0.4 or more.

The definition of the calcium ion-binding capacity and clay deispersibility is the same as defined in the Examples described hereinafter.

Liquid Detergent Builder 2:

The liquid detergent builder 2 comprises the copolymer 2 as the essential component.

Specifically, the liquid detergent builder may consist of the copolymer 2, or may further comprise other conventional detergent builders.

The other detergent builder is not particularly limited, and includes the same builders as described for the liquid detergent builder 1.

Water-soluble polymers used together are the following water-soluble carboxylic acid-based polymers.

Examples of the water-soluble polycarboxylic acid-based polymer include acrylic acid-based polymer (salt), acrylic acid/maleic acid-based copolymer (salt), methacrylic acid-based polymer (salt), α-hydroxyacrylic acid-based polymer (salt), acrylic acid/hydroxyl group-containing monomer-based copolymer (salt), and methacrylic acid/hydroxyl group-containing monomer-based copolymer (salt). Those polymers may be used alone or as mixtures of two or more thereof.

Of those polymers, acrylic acid-based polymer (salt) and acrylic acid/acrylic acid-based copolymer (salt) are particularly preferable.

The acrylic acid-based polymer (salt) comprises 90 mol % or more of a structural unit derived from acrylic acid and 10 mol % or less of a structural unit derived from other copolymerizable monomers. Examples of the other copolymerizable monomer include the same monomers as described for the copolymer 1.

The weight average molecular weight of the acrylic acid-based polymer (salt) is not particularly limited, and is generally 1,000-100,000, preferably 1,500-75,000, more preferably 2,000-50,000, even more preferably 3,000-30,000, and most preferably 4,000-20,000.

The acrylic acid-based polymer (salt) has a calcium ion-binding capacity of 200 mg $CaCO_3$/g or more, preferably 230 mg $CaCO_3$/g or more, and most preferably 250 mg $CaCO_3$/g or more.

The acrylic acid-based polymer (salt) has a clay dispersibility in high hardness water of 0.2 or more, preferably 0.25 or more, more preferably 0.30 or more, and most preferably 0.35 or more.

The acrylic acid-based polymer (salt) can be added to the liquid detergent builder 2 such that a mass ratio of copolymer 2/acrylic acid-based polymer (salt) is 1/99 to 100/0, preferably 5/95 to 100/0, more preferably 10/90 to 100/0, and most preferably 20/80 to 100/0.

The acrylic acid-based polymer (salt) may contain the acrylic acid-based polymer (salt) that is the polymer of the invention.

The acrylic acid/maleic acid-based copolymer (salt) that may be used in combination with the acrylic acid/HAPS-based copolymer (salt) is preferably an acrylic acid/maleic acid-based copolymer (salt) comprising 5-90 mol % of maleic acid per mole of the sum of acrylic acid (salt) and maleic acid (salt), wherein the product (MA×Mw) of a weight average molecular weight Mw of the copolymer (salt) and proportion (MA (mol %)) of the maleic acid (salt) in the copolymer (salt) is 450,000 or less. The proportion of MA is preferably 10-85 mol %, more preferably 15-80 mol %, still more preferably 20-70 mol %, and most preferably 25-60 mol %. The weight average molecular weight Mw is preferably 1,000-90,000, more preferably 1,500-70,000, even more preferably 2,000-50,000, still more preferably 2,500-30,000, and most preferably 3,000-20,000.

The acrylic acid/maleic acid-based copolymer (salt) is preferably added to the liquid detergent builder 2 such that a mass ratio of copolymer 2/(acrylic acid/maleic acid-based copolymer (salt)) is 10/90 to 100/0, preferably 20/80 to 100/0, more preferably 30/70 to 100/0, and most preferably 50/50 to 100/0.

Where the liquid detergent builder 2 comprises, for example, the copolymer 2 (hereinafter referred to as "polymer A)" and any other polymer (hereinafter referred to as "polymer B"), the mixing method can be the same as described for the detergent builder 1.

The liquid detergent builder 2 contains the copolymer 2 in an amount of 10-100 mass %, preferably 20-90 mass %, more preferably 30-80 mass %, and most preferably 40-70 mass %. It should be noted that this proportion is calculated excluding water contained in the liquid detergent builder 2.

The liquid detergent builder 2 may be in a powdery form such mass, powder, sol or gel, or may also be in a solution form such as an aqueous solution.

When the liquid detergent builder 2 is used as a liquid detergent as described hereinafter, it is very excellent as a builder for a liquid detergent in that the builder has excellent compatibility with a surfactant, thereby forming a highly concentrated liquid detergent. Due to excellent compatibility with a surfactant, when the builder is added to a liquid detergent, the resulting liquid detergent has excellent transparency. This can prevent the problem of separation of a liquid detergent, caused due to turbidity. Further, such an excellent compatibility makes it possible to form a highly concentrated liquid detergent, leading to the improvement of detergency of a liquid detergent.

Polymer for the Invention:

The polymer for the invention is an acrylic acid-based polymer (salt), and has a weight average molecular weight Mw of 500-4,500, preferably 700-4,000, more preferably 800-3,500, even more preferably 900-3,000, and most preferably 1,000-2,500.

The polymer for the invention comprises 50-100 mol % of structural units derived from acrylic acid (salt), and contains 50 mol % or less, preferably 40 mol % or less, more preferably 30 mol % or less, even more preferably 20 mol % or less, and most preferably 10 mo % or less, of structural units derived from other copolymerizable monomer. The copolymerizable monomer can be the same monomers as described for the copolymer 1.

The copolymerizable monomer other than acrylic acid (salt) used in the polymer for the invention is not particularly limited, including, and for example, the same monomers as described for the copolymer 1 can be used. Examples of the copolymerizable monomer include maleic acid (salt), fumaric acid (salt), and methacrylic acid (salt). The molar ratio of acrylic acid (salt) units/other monomer units is 50/50 to 100/0, preferably 70/30 to 100/0, more preferably 80/20 to 100/0, still more preferably 90/10 to 100/0, and most preferably 95/5 to 100/0.

The method of polymerization or copolymerization for producing the polymer for the invention is not particularly limited. However, it is preferably to use a chain transfer agent, and it is more preferably to use a polymer having terminal sulfonic acid group.

The reason for limiting the composition and Mw of the acrylic acid-based polymer (salt) is secure the compatibility of the polymer with a surfactant while satisfying the calcium ion-binding capacity and the clay dispersibility thereof.

The polymer for the invention has a clay dispersibility in high hardness water of 0.5 or more, preferably 0.6 or more, more preferably 0.7 or more, and most preferably 0.8 or more.

The polymer for the invention has a calcium ion-binding capacity of 150 mg $CaCO_3$/g or more, preferably 160 mg $CaCO_3$/g or more, more preferably 170 mg $CaCO_3$/g or more, and most preferably 180 mg $CaCO_3$/g or more.

The definition of the calcium ion-binding capacity and the clay dispersibility is described in the Examples as described hereinafter.

Liquid Detergent Builder 3:

Liquid detergent builder 3 comprises the polymer for the invention as the essential component.

Specifically, the liquid detergent builder 3 may consist of the polymer for the invention, or may further comprise conventional detergent builders.

The conventional detergent builder is not particularly limited, and the same builders as described for the liquid detergent builder 1 can be used.

The water-soluble polymers used together with the polymer are the following water-soluble polycarboxylic acid-based polymers.

Examples of the water-soluble polycarboxylic acid-based polymer include acrylic acid-based polymer (salt), acrylic acid/maleic acid-based copolymer (salt), methacrylic acid-based polymer (salt), α-hydroxyacrylic acid-based polymer (salt), acrylic acid/hydroxyl group-containing monomer-based copolymer (salt), and methacrylic acid/hydroxyl group-containing monomer-based copolymer (salt). Those may be used alone or as mixtures of two or more thereof.

Of those polymers, acrylic acid-based polymer (salt) and acrylic acid/maleic acid-based copolymer (salt) are preferably used.

The acrylic acid-based polymer (salt) comprises 90 mol % or more of a structural unit derived from acrylic acid and 10 mol % or less of a structural unit derived from other copolymerizable monomers. Examples of the other copolymerizable monomer include the same monomers as described for the copolymer 1.

The weight average molecular weight of the acrylic acid-based polymer (salt) is not particularly limited, and is generally 500-4,500, preferably 700-4,000, more preferably 800-3,500, even more preferably 900-3,000, and most preferably 1,000-2,500.

The acrylic acid-based polymer (salt) has a calcium ion-binding capacity of 200 mg $CaCO_3$/g or more, preferably 230 mg $CaCO_3$/g or more, and more preferably 250 mg $CaCO_3$/g or more.

The acrylic acid-based polymer (salt) has a clay dispersibility in high hardness water of 0.20 or more, preferably 0.25 or more, more preferably 0.30 or more, and most preferably 0.35 or more.

The acrylic acid-based polymer (salt) can be added to the liquid detergent builder 3 such that a mass ratio of copolymer 3/acrylic acid-based polymer (salt) is 1/99 to 100/0, preferably 5/95 to 100/0, more preferably 10/90 to 100/0, and most preferably 20/80 to 100/0.

The acrylic acid/maleic acid-based copolymer (salt) that may be used in combination with the acrylic acid-based copolymer (salt) is preferably an acrylic acid/maleic acid-based copolymer (salt) comprising 5-90 mol % of maleic acid per mole of the sum of acrylic acid (salt) and maleic acid (salt), wherein the product (MA×Mw) of a weight average molecular weight Mw of the copolymer (salt) and proportion (MA (mol %)) of the maleic acid (salt) in the copolymer (salt) is 450,000 or less. The proportion of MA is preferably 10-85 mol %, more preferably 15-80 mol %, still more preferably 20-70 mol %, and most preferably 25-60 mol %. The weight average molecular weight Mw is preferably 1,000-90,000, more preferably 1,500-70,000, even more preferably 2,000-50,000, still more preferably 2,500-30,000, and most preferably 3,000-20,000.

The acrylic acid/maleic acid-based copolymer (salt) is preferably added to the liquid detergent builder 3 such that a mass ratio of the polymer for the invention/(acrylic acid/maleic acid-based copolymer (salt)) is 10/90 to 100/0, preferably 20/80 to 100/0, more preferably 30/70 to 100/0, and most preferably 50/50 to 100/0.

Where the liquid detergent builder 3 comprises, for example, the polymer for the invention (hereinafter referred to as "polymer A)" and any other polymer (hereinafter referred to as "polymer B"), the mixing method can be the same as described for the detergent builder 1.

The liquid detergent builder 3 contains the polymer for the invention in an amount of 10-100 mass %, preferably 20-90 mass %, more preferably 30-80 mass %, and most preferably 40-70 mass %. It should be noted that this proportion is calculated excluding water contained in the liquid detergent builder 3.

The liquid detergent builder 3 may be in a powdery form such mass, powder, sol or gel, or may also be in a solution form such as an aqueous solution.

When the liquid detergent builder 3 is used in a liquid detergent as described hereinafter in an amount of 0.5 mass % or more, it is very excellent as a builder for a liquid detergent in that the builder has excellent compatibility with a surfactant, thereby forming a highly concentrated liquid detergent. Due to excellent compatibility with a surfactant, when the builder is added to a liquid detergent, the resulting liquid detergent has excellent transparency. This can prevent the problem of separation of a liquid detergent, caused due to turbidity. Further, such an excellent compatibility makes it possible to form a highly concentrated liquid detergent, leading to the improvement of detergency of a liquid detergent.

Liquid Detergent:

Liquid detergent comprising the builder 1 or 2 according to the present invention is referred to as "liquid detergent (a)".

The liquid detergent builder 1 or 2 contained in the liquid detergent (a) has excellent compatibility with a surfactant. As a result, when such a builder is added to a liquid detergent, the resulting liquid detergent has excellent transparency. This can prevent the problem of separation of a liquid detergent, caused due to turbidity. Further, such an excellent compatibility makes it possible to form a highly concentrated liquid detergent, leading to the improvement of detergency of a liquid detergent.

The liquid detergent (a) contains the liquid detergent builder 1 or 2 that can impart excellent detergency, and therefore can exhibit excellent detergency as compared with conventional liquid detergents.

The liquid detergent (a) generally contains a detergent surfactant, in addition to the liquid detergent builder 1 or 2.

The surfactant is at least one selected from anionic surfactants, nonionic surfactants, cationic surfactants and amphoteric surfactants. Those surfactants can be used alone or as mixtures of two or more thereof. When two or more surfactants are used in the liquid detergent (a), the total amount of the anionic surfactant and the nonionic surfactant is preferably 50 mass % or more, more preferably 60 mass % or more, even more preferably 70 mass % or more, and most preferably 80 mass % or more, based on the mass of all the surfactants.

Examples of the anionic surfactants include salts of alkylbenzenesulfonic acids, salts of alkyl or alkenyl ether sulfuric acids, salts of alkyl or alkenyl sulfuric acids, salts of α-olefinsulfonic acids, salts of α-sulfofatty acids or their esters, salts of alkanesulfonic acids, salts of saturated or unsaturated fatty acids, salts of alkyl or alkenyl ether carboxylic acids, amino acid-type surfactants, N-acylamino acid-type surfactants, and alkyl or alkenyl phosphates or their salts.

The alkyl or alkenyl chain in these anionic surfactants may be branched with an additional alkyl group such as methyl group.

Examples of the nonionic surfactants include polyoxyalkylene alkyl or alkenyl ethers, polyoxyethylene alkylphenyl ethers, higher fatty acid alkanolamides or their alkyleneoxide adducts, sucrose fatty acid esters, alkyl glycoxides, fatty acid glycerin monoesters, and alkylamine oxides. The alkyl or alkenyl chain in these nonionic surfactants may be branched with an additional alkyl group such as methyl group.

Examples of the cationic surfactants are quaternary ammonium salts.

Examples of the amphoteric surfactants are carboxyl-type or sulfobetaine-type amphoteric surfactants.

The alkyl or alkenyl chain in these cationic surfactants and amphoteric surfactants may be branched with an additional alkyl group such as methyl group.

The proportion of the surfactant contained in the liquid detergent (a) is generally 10-60 mass %, preferably 15-50 mass %, more preferably 20-45 mass %, and most preferably 25-40 mass %, based on the mass of the liquid detergent. If the proportion of the surfactant is smaller than 10 mass %, the liquid detergent cannot exhibit sufficient detergency. On the other hand, if it is larger than 60% by mass, such is uneconomical.

The proportion of the liquid detergent builder 1 or 2 contained in the liquid detergent (a) is generally 0.1-40 mass %, preferably 0.2-30 mass %, more preferably 0.3-20 mass %, even more preferably 0.4-15 mass %, and most preferably 0.5-10 mass %, based on the mass of the liquid detergent. If the proportion of the liquid detergent builder 1 or 2 is smaller than 0.1 mass %, the liquid detergent cannot exhibit sufficient detergency. On the other hand, if it is larger than 40 mass %, such is uneconomical.

A liquid detergent containing the liquid detergent builder 3 as the essential component (hereinafter referred to as "liquid detergent (b)") is described below.

The liquid detergent (b) contains the liquid detergent builder 3 in an amount of 0.5 mass % or more, preferably 0.6-30 mass %, more preferably 0.7-20 mass %, even more preferably 0.8-10 mass %, and most preferably 0.9-5 mass %, based on the mass of the liquid detergent (b).

The liquid detergent builder 3 contained in the liquid detergent (b) has excellent compatibility with a surfactant. As a result, when such a builder is added to a liquid detergent, the resulting liquid detergent has excellent transparency. This can prevent the problem of separation of a liquid detergent, caused due to turbidity. Further, such an excellent compatibility makes it possible to form a highly concentrated liquid detergent, leading to the improvement of detergency of a liquid detergent.

If the proportion of the liquid detergent builder 3 is smaller than 0.5 mass %, the liquid detergent (b) cannot exhibit sufficient detergency. On the other hand, if it is larger than 30 mass %, such is uneconomical.

The liquid detergent (b) contains the liquid detergent builder 3 that can impart excellent detergency, and therefore can exhibit excellent detergency as compared with conventional liquid detergents.

The surfactant contained in the liquid detergent (b) is at least one selected from anionic surfactants, nonionic surfactants, cationic surfactants and amphoteric surfactants. Those surfactants can be used alone or as mixtures of two or more thereof. When two or more surfactants are used in the liquid detergent of the invention, the total amount of the anionic surfactant and the nonionic surfactant is preferably 50 mass % or more, more preferably 60 mass % or more, even more preferably 70 mass % or more, and most preferably 80 mass % or more, based on the mass of all the surfactants.

The surfactants can use the same surfactants as described for the liquid detergent (a).

The proportion of the surfactant contained in the liquid detergent (b) is generally 25 mass % or more, preferably 27.5-60 mass %, more preferably 30-50 mass %, and most preferably 32.5-45 mass %.

The water content contained in the liquid detergent of the invention is generally 0.1-75 mass %, preferably 0.2-70 mass %, more preferably 0.5-65 mass %, even more preferably 0.7-60 mass %, still more preferably 1-55 mass %, and most preferably 1.5-50 mass %.

The liquid detergent of the invention may contain the liquid detergent builders 1 and 2 as well as builder 3 either alone or in combination. When the builders 1 and 2 are used in combination in the liquid detergent of the invention, their proportion is derived from the substitution of builder 1 or 2 alone with the total of the two builders. Specifically, the mass ratio of copolymer 1/polymer for the invention is preferably 99/1 to 1/99, more preferably 98/2 to 10/90, even more preferably 97/3 to 30/70, and most preferably 96/4 to 50/50, and the mass ratio of copolymer 1 or 2/polymer for the invention is preferably 1/99 to 99/1, more preferably 98/2 to 2/98, even more preferably 97/3 to 3/97, and most preferably 96/4 to 4/96.

Kaolin turbidity of the liquid detergent of the invention is 200 mg/liter or less, preferably 150 mg/liter or less, more preferably 120 mg/liter or less, even more preferably 100 mg/liter or less, and most preferably 50 mg/liter or less.

Change (difference) in the kaolin turbidity between the liquid detergent containing the acrylic acid/maleic acid-based copolymer (salt) and/or the acrylic acid/HAPS-based copolymer (salt) and/or the acrylic acid-based polymer (salt) of the invention and the liquid detergent not containing those is preferably 500 mg/liter or less, more preferably 400 mg/liter or less, even more preferably 300 mg/liter or less, still more preferably 200 mg/liter or less, and most preferably 100 mg/liter or less.

The liquid detergent builder 1, 2 or 3 according to the present invention can contain various conventional additives. For example, the additives are stain inhibitors for preventing re-deposition of contaminants, such as sodium carboxymethyl cellulose, benzotriazole or ethylene-thiourea; alkaline substances for pH control; perfumes, solubilizers, fluorescent substances, colorants, foaming agents, glazing agents, microbicides, bleaching agents, enzymes, dyes, solvents, etc.

EXAMPLES

The present invention is described in more detail with reference to the following Examples, but it should be understood that the invention is not construed as being limited thereto. Unless otherwise indicated, "%" is "mass %".

Method of Determining Physical Properties

Methods for determining a calcium ion-binding capacity and a clay dispersibility in high hardness water that are the fundamentals and important parameters of the present invention are described below. For the sake of reference, the weight average molecular weight of the polymer used is also measured, and the method for measuring the weight average molecular weight is also described below.

Calcium Ion-Binding Capacity:

Calcium ion standard solutions for calibration curve were prepared in the following manner. Using calcium chloride dihydrate, 50 g of each of aqueous solutions having a $Ca^{2+}$ ion concentration of 0.01 mol/liter, 0.001 mol/liter and 0.0001 mol/liter was prepared. The pH of each aqueous solution was controlled to fall within a range of 9-11 with aqueous 4.8% NaOH aqueous solution. Further, 1 ml of 4 mol/liter aqueous potassium chloride solution (hereinafter referred to as "4M-KCl aqueous solution") was added to each solution, followed by thoroughly stirring with a magnetic stirrer. Thus, sample aqueous solutions for calibration curve were prepared. On the other hand, calcium ion standard solutions for test were prepared in the following manner. Using calcium chloride dihydrate, a necessary amount (50 g per one sample) of aqueous solution having a $Ca^{2+}$ ion concentration of 0.001 molliter was prepared.

The test sample (polymer) in an amount of 10 mg calculated as solids content was weighed in a 100 ml beaker, and 50 g of the calcium ion standard solution for test was then added to the beaker. The resulting mixture was thoroughly stirred with a magnetic stirrer. The pH of the resulting solution was adjusted to a range of 9-11 with a 4.8% NaOH aqueous solution in the same manner as in the sample for calibration curve, and 1 ml of 4M-KCl aqueous solution was then added thereto to prepare sample solutions for test.

Using a titration device, COMTITE-550, manufactured by Hiranuma Sangyo K.K., the thus-prepared sample solutions for calibration curve and sample solutions for test were analyzed with a calcium ion electrode 93-20 and a reference electrode 90-01 (manufactured by Orion Corporation).

The amount of calcium ions bound by the sample (polymer) was calculated from the measurement values of the sample solutions for calibration curve and those for test, and the binding amount per gram of the solid content of the polymer was expressed in terms of milligram number calculated as calcium carbonate. This value was defined as a calcium ion-binding value.

Clay Dispersibility in High Hardness Water (200 ppm Calculated as $CaCO_3$):

Pure water was added to 67.56 g of glycine, 52.6 g of sodium chloride and 2.4 g of NaOH to make 600 g (buffer 1). 0.3268 g of calcium chloride dihydrate was added to 60 g of buffer 1, and pure water was further added thereto to make 1,000 g (buffer 2). 36 g of buffer 2 was added to 4 g (in terms of the solid content) of a 0.1 mass % aqueous solution of the copolymer to be analyzed, and the mixture was stirred to prepare a dispersion. 0.3 g of clay (Dust 11 type for test, by the Association of Powder Process Industry and Engineering, Japan) was put into a test tube (diameter: 18 mm and height: 180 mm, manufactured by Iwaki Glass Co.), and 30 g of the dispersion was then added thereto. The test tube was sealed up.

The test tube was shaken to uniformly disperse the clay therein. The test tube was allowed to stand in a dark place for 20 hours. After 20 hours, 5 ml of the supernatant of the dispersion was collected, and its absorbance was measured with an UV spectrophotometer (UV-1200; 1 cm cell, wavelength 380 nm; manufactured by Shimadzu Corporation).

Clay Dispersibility in Low Hardness Water (50 ppm Calculated as $CaCO_3$)

The clay dispersibility in low hardness water was measured in the same manner as in the above measurement of the clay dispersibility in high hardness water, except that the amount of calcium chloride dihydrate added was changed to 0.0817 g (corresponding to 50 ppm calculated as calcium carbonate).

Measurement of Weight Average Molecular Weight (Mw):

(1) Weight average molecular weigh of polymers was measured by GPC (gel permeation chromatography). The column used was G-3000PWXL (manufactured by Tosoh Corporation). The mobile phase was an aqueous solution prepared as follows: Pure water was added to 34.5 g of disodium hydrogenphosphate 12 hydrates and 46.2 g of sodium dihydrogenphosphate dihydrate (both special-grade reagents; the reagents used hereinafter for analysis are all special-grade reagents) to make 5,000 g as a whole, and this solution was then filtered through a 0.45 micron membrane filter.

(2) Using a pump, L-7110 (manufactured by Hitachi Ltd.), the flow rate of the mobile phase was set at 0.5 ml/min. An RI detector, SHOPEX SE-61 (manufactured by Showa Denko Co.), was used. The column temperature was set constant at 35° C.

(3) For calibration curve, sodium polyacrylate standard samples (manufactured by Sowa Science Co.) were used. The weight average molecular weight of the polymer to be analyzed was determined using the calibration curve.

Determination of Solid Content:

One gram of an aqueous solution of (co)polymer was dried in a hot air drier at 170° C. for 1 hour, and the non-volatile component remained after the drying was defined as the solid content of the sample.

Synthesis Example 1

Synthesis of Copolymer 1:

Copolymer 1, acrylic acid/maleic acid copolymer of 52/48 in molar ratio, was produced in the following manner. 34.5 g of ion-exchanged water (hereinafter referred to as "pure water") and 1,155.7 g of a 40% aqueous disodium maleate solution (hereinafter referred to as "40% $MANa_2$") were placed in a 2.5 liters separable flask made of SUS equipped with a thermometer, a stirrer and a reflux condenser. The aqueous solution was heated up to the boiling point thereof for reflux under stirring. While maintaining reflux state under stirring, 287.1 g of a 80% acrylic acid aqueous solution (hereinafter referred to as "80% AA") and 73 g of a 35% hydrogen peroxide aqueous solution (hereinafter referred to as "35% $H_2O_2$") were added dropwise the flask over a period of 264 minutes after the start of the polymerization, 85.5 g of a 15% sodium persulfate aqueous solution (hereinafter referred to as "15% NaPS") was added dropwise thereto over a period of 275 minutes after the start of the polymerization, and 137.9 g of pure water was added dropwise thereto over a period of 180 minutes after 95 minutes from the start of the polymerization, all continuously at a constant rate via the respective dropping nozzles. After all the components were completely added dropwise to the flask, the resulting mixture was maintained under reflux at the boiling point thereof for 30 minutes to complete the polymerization. 87.9 g of a 48% sodium hydroxide aqueous solution (hereinafter referred to as "48% NaOH") was added to the flask, and the resulting mixture was stirred for 30 minutes. 21.1 g of 35% sodium hydrogensulfite aqueous solution (hereinafter referred to as "35% Na hydrogensulfite"), 14 g of 48% NaOH and 106.9 g of pure water were added to the flask to obtain copolymer 1. Its weight-average molecular weight was measured according to the method as described above, and it was found to be 5,000. Its solid content was 37%.

Synthesis Example 2

Synthesis of Copolymer 2:

Copolymer 2, acrylic acid/maleic acid copolymer of 60/40 in molar ratio, was produced in the following manner. 295 g of pure water was placed in a 2.5 liters separable flask made of SUS equipped with a thermometer, a stirrer and a reflux condenser. The water was heated up to the boiling point thereof for reflux under stirring. While maintaining reflux state under stirring, 156.8 g of maleic anhydride (hereinafter referred to as "MA anhydride") was added dropwise to the flask over a period of 100 minutes after the start of the polymerization, 216 g of 80% AA and 256.7 g of 48% NaOH were added dropwise to the flask over a period of 180 minutes after the start of the polymerization, 68.6 g of 35% $H_2O_2$ was added dropwise to the flask over a period of 120 minutes after the start of the polymerization, and 106.7 g of 15% NaPS was added dropwise to the flask over a period of 190 minutes after the start of the polymerization, all continuously at a constant rate via the respective dropping nozzles. After all the components were completely added to the flask, the resulting mixture was maintained under reflux at the boiling point thereof for 60 minutes to complete the polymerization. 140 g of 48% NaOH was added to the flask, and the resulting mixture was stirred for 30 minutes to obtain copolymer 2. Its weight average molecular weight was measured according to the method as described above, and it was found to be 4,800. Its solid content was 39%.

Synthesis Example 3

Synthesis of Copolymer 3:

Copolymer 3, acrylic acid/maleic acid copolymer of 71/29 in molar ratio, was produced in the following manner. 35.7 g of pure water and 722 g of 40% $MANa_2$ were placed in a 2.5 liters separable flask made of SUS equipped with a thermometer, a stirrer and a reflux condenser. The aqueous solution was heated up to the boiling point thereof for reflux under stirring. While maintaining reflux state under stirring, 401.7 g of 85% AA, 89.3 g of 35% $H_2O_2$ were added dropwise to the flask over a period of 240 minutes after the start of the polymerization, 124.7 g of 15% NaPS was added dropwise to the flask over a period of 245 minutes after the start of the polymerization, and 177.5 g of pure water was added dropwise to the flask over a period of 156 minutes after 90 minutes from the start of the polymerization, all continuously at a constant rate via the respective dropping nozzles. After all the components were completely added to the flask, the resulting mixture was maintained under reflux at the boiling point thereof for 30 minutes to complete the polymerization. 263 g of 48% NaOH was added to the flask, and the resulting mixture was stirred for 30 minutes. 27.9 g of 35% Na hydrogensulfite, 50.9 g of 48% NaOH and 128.6 g of pure water were added to the flask to obtain copolymer 3. Its weight average molecular weight was measured according to the method as described above, and it was found to be 11,000. Its solid content was 36%.

Synthesis Example 4

Synthesis of Copolymer 4:

Copolymer 4, acrylic acid/Na 3-allyloxy-2-hydroxy-1-propanesulfonate (HAPS) copolymer of 91/9 in molar ratio, was produced in the following manner. 774 g of pure water was placed in a 5 liters separable flask of SUS equipped with a thermometer, a stirrer and a reflux condenser. The water was heated up to the boiling point thereof for reflux under stirring. While maintaining reflux state under stirring, 47.8 g of 80% AA, 957.7 g of 37% sodium acrylate (hereinafter referred to as "37% SA") and 9.6 g of 35% $H_2O_2$ were added dropwise to the flask over a period of 120 minutes after the start of the polymerization, 370.9 g of a 25% HAPS aqueous solution (hereinafter referred to as "25% HAPS") was added dropwise to the flask over a period of 90 minutes after the start of the polymerization, and 97.2 g of 15% NaPS was added dropwise to the flask over a period of 140 minutes after the start of the polymerization, all continuously at a constant rate via the respective dropping nozzles. Thus, copolymer 4 was obtained. Its weight average molecular weight was measured according to the method described above, and it was found to be 3,000. Its solid content was 45%.

Synthesis Example 5

Synthesis of Copolymer 5:

Copolymer 5, acrylic acid/maleic acid copolymer of 50/50 in molar ratio, was produced in the following manner. 132.8 g of pure water, 400 g of 48% NaOH and 235.2 g of MA anhydride were placed in a 2.5 liters separable flask made of SUS equipped with a thermometer, a stirrer and a reflux condenser. The aqueous solution was heated up to the boiling point thereof for reflux under stirring. While maintaining reflux state under stirring, 216 g of 80% AA was added dropwise to the flask over a period of 180 minutes after the start of the polymerization, 57.6 g of 35% $H_2O_2$ was added dropwise thereto over a period of 90 minutes after the start of the polymerization, and 96 g of 15% NaPS and 160 g of pure water were added dropwise thereto over a period of 190 minutes after 90 minutes from the start of the polymerization, all continuously at a constant rate via the respective dropping nozzles. After all the components were completely added to the flask, the resulting mixture was maintained under reflux at the boiling point thereof for 30 minutes to complete the polymerization, thereby obtaining copolymer 5. Its weight average molecular weight was measured according to the method described above, and it was found to be 10,000. Its solid content was 45%.

Synthesis Example 6

Synthesis of Copolymer 6:

Copolymer 6, acrylic acid/maleic acid copolymer of 70/30 in molar ratio, was produced in the following manner. 83.0 g of pure water, 250 g of 48% NaOH and 147.0 g of MA anhydride were placed in a 2.5 liters separable flask made of SUS equipped with a thermometer, a stirrer and a reflux condenser. The aqueous solution was heated up to the boiling point thereof for reflux under stirring. While maintaining reflux state under stirring, 315.0 g of 80% AA was added dropwise to the flask over a period of 120 minutes after the start of the polymerization, and 66.7 g of 15% NaPS and 393.3 g of pure water were added dropwise thereto over a period of 130 minutes after the start of the polymerization, all continuously at a constant rate via the respective dropping nozzles. After all the components were completely added to the flask, the resulting mixture was maintained under reflux at the boiling point thereof for 30 minutes to complete the polymerization, thereby copolymer 6. Its weight average molecular weight was measured according to the method described above, and it was found to be 50,000. Its solid content was 40%.

Synthesis Example 7

Synthesis of Polymer 1:

Polymer 1, acrylic acid homopolymer having a low molecular weight was produced in the following manner. 560 g of pure water was placed in a 2.5 liters separable flask made of SUS equipped with a thermometer, a stirrer and a reflux condenser. The water was heated up to the boiling point thereof for reflux under stirring. While maintaining reflux state under stirring, 360 g of 80% AA and 283 g of 48% NaOH were added dropwise to the flask over a period of 240 minutes after the start of the polymerization, and 56 g of 15% NaPS and 600 g of pure water were added dropwise thereto over a period of 250 minutes after the start of the polymerization, all continuously at a constant rate via the respective dropping nozzles. After all the components were completely added to the flask, the resulting mixture was maintained under reflux at the boiling point thereof for 30 minutes to complete the polymerization, thereby obtaining polymer 1. Its weight average molecular weight was measured in the same manner as above, and it was found to be 6,000. Its concentration was adjusted to have a solid content of 45%.

Synthesis Example 8

Synthesis of Polymer 2:

Polymer 2, acrylic acid homopolymer, was produced in the following manner. 150 g of pure water was placed in a 5 liters separable flask made of SUS equipped with a thermometer, a stirrer and a reflux condenser. With stirring, this was heated up to 90° C. While maintaining the temperature at 90° C. with stirring, 285.7 g of 35% Na hydrogensulfite was added dropwise to the flask over a period of 180 minutes including 10 minutes before the start of the polymerization, 900 g of 80% AA and 41.67 g of 48% NaOH were thereto over a period of 180 minutes after the start of the polymerization, and 142.9 g of 35% NaPS was added dropwise thereto over a period of 190 minutes after the start of the polymerization, all continuously at a constant rate via the respective dropping nozzles. After all the components were completely added to it, the resulting mixture was maintained at 90° C. for 30 minutes to complete the polymerization. 750 g of 48% NaOH was then added to the flask to adjust its concentration, and polymer 2 having a solid content of 45% was thus obtained. Its weight average molecular weight was measured in the same manner as above, and it was found to be 2,000.

Synthesis Example 9

Synthesis of Polymer 3:

Polymer 3, acrylic acid homopolymer, was produced in the following manner. 145 g of pure water was placed in a 2.5 liters separable flask made of SUS equipped with a thermometer, a stirrer and a reflux condenser. With stirring, the mixture was heated up to 90° C. While maintaining the temperature at 90° C. with stirring, 405 g of 80% AA and 127.0 g of 37% SA were added dropwise to the flask over a period of 240 minutes after the start of the polymerization, and 80.0 g of 25% NaPS and 85.7 g of 35% Na hydrogensulfite were added dropwise thereto over a period of 250 minutes after the start of the polymerization, all continuously at a constant rate via the respective dropping nozzles. After all the components were completely added to it, the resulting mixture was maintained at 90° C. for 30 minutes to complete the polymerization. 333 g of 48% NaOH was added to the flask to adjust its concentration, and polymer 3 having a solid content of 45% was thus obtained. Its weight average molecular weight was measured in the same manner as above, and it was found to be 4,100.

Synthesis Example 10

Synthesis of Polymer 4:

Polymer 4, acrylic acid homopolymer, was produced in the following manner. 175 g of pure water was placed in a 2.5 liters separable flask made of SUS equipped with a thermometer, a stirrer and a reflux condenser. With stirring, this was heated up to 90° C. While stirring at 90° C., 450 g of 80% AA and 20.83 g of 48% NaOH were added dropwise to the flask over a period of 300 minutes after the start of the polymerization, 66.7 g of 15% NaPS was added dropwise thereto over a period of 310 minutes after the start of the polymerization, and 71.4 g of 35% Na hydrogensulfite was added dropwise thereto over a period of 290 minutes after the start of the polymerization, all continuously at a constant rate via the respective dropping nozzles. After all the components were completely added to it, the resulting mixture was maintained at 90° C. for 30 minutes to complete the polymerization. 375 g of 48% NaOH was added to the flask to adjust its concentration, and polymer 4 having a solid content of 45% was thus obtained. Its weight average molecular weight was measured in the same manner as above, and it was found to be 6,000.

Synthesis Example 11

Synthesis of Copolymer 7:

Copolymer 7, maleic acid/acrylic acid copolymer of 5/95 in molar ratio, was produced in the following manner. 190 g of pure water, 29.4 g of maleic anhydride and 2.5 g of 48% NaOH were placed in a 2.5 liters separable flask made of SUS equipped with a thermometer, a stirrer and a reflux condenser. With stirring, the mixture was heated up to 90° C. While stirring at 90° C., 513 g of 80% AA and 23.8 g of 48% NaOH were added dropwise added to the flask over a period of 180 minutes after the start of the polymerization, 200.0 g of 15% NaPS was added dropwise thereto over a period of 185 minutes after the start of the polymerization, and 171.4 g of 35% Na hydrogensulfite was added dropwise thereto over a period of 175 minutes after the start of the polymerization, all continuously at a constant rate via the respective dropping nozzles. After all the components were completely added to the flask, the resulting mixture was maintained at 90° C. for 30 minutes to complete the polymerization. 420 g of 48% NaOH was added to the flask to adjust its concentration, and copolymer 7 having a solid content of 45% was thus obtained. Its weight average molecular weight was measured in the same manner as above, and it was found to be 3,600.

Synthesis Example 12

Synthesis of Copolymer 8:

Copolymer 8, maleic acid/acrylic acid copolymer of 5/95 in molar ratio, was produced in the following manner. 190 g of pure water, 29.4 g of maleic anhydride and 2.5 g of 48% NaOH were placed in a 2.5 liters separable flask made of SUS equipped with a thermometer, a stirrer and a reflux condenser. With stirring, the mixture was heated up to 90° C. While stirring at 90° C., 513 g of 80% AA and 23.8 g of 48% NaOH were added dropwise to the flask over a period of 180 minutes after the start of the polymerization, 160.0 g of 15% NaPS was added dropwise thereto over a period of 185 minutes after the start of the polymerization, and 137.1 g of 35% Na hydrogensulfite was added dropwise thereto over a period of 175 minutes after the start of the polymerization, all continuously at a constant rate via the respective dropping nozzles. After all the components were completely added to the flask, the resulting mixture was maintained at 90° C. for 30 minutes to complete the polymerization. 420 g of 48% NaOH was added to the flask to adjust its concentration, and copolymer 8 having a solid content of 45% was thus obtained. Its weight average molecular weight was measured in the same manner as above, and it was found to be 7,200.

Example 1-1

Copolymer 1 alone was used as a liquid detergent builder.

Example 1-2

Copolymer 2 alone was used as a liquid detergent builder.

Example 1-3

Copolymer 3 alone was used as a liquid detergent builder.

Example 1-4

24.3 g of aqueous solution of copolymer 1 and 2.2 g of aqueous solution of polymer 1 were mixed to obtain a completely uniform solution. Thus, a liquid detergent builder comprising copolymer 1/polymer 1 in a mass ratio of 90/10 was obtained.

Example 1-5

A liquid detergent builder was produced in the same manner as in Example 1-4, except that the mass ratio of copolymer 1/polymer 1 was changed to 80/20.

Example 1-6

A liquid detergent builder comprising copolymer 3/polymer 1 in a mass ratio of 90/10 was produced in the same manner as in Example 1-4, except that copolymer 3 was used in place of copolymer 1.

Example 1-7

A liquid detergent builder comprising copolymer 1/copolymer 4 in a mass ratio of 80/20 was produced in the same manner as in Example 1-5, except that copolymer 4 was used in place of polymer 1.

Example 1-8

A liquid detergent builder comprising copolymer 3/copolymer 4 in a mass ratio of 90/10 was produced in the same manner as in Example 1-6, except that copolymer 4 was used in place of polymer 1.

Comparative Example 1-1

Copolymer 5 alone was used as a liquid detergent builder.

Comparative Example 1-2

Copolymer 6 alone was used as a liquid detergent builder.

Comparative Example 1-3

Polymer 1 alone was used as a liquid detergent builder.

Calcium ion-binding capacity and clay dispersibility in high hardness water of the liquid detergent builders obtained in the Examples and Comparative Examples were determined. In addition, 1 mass % of each builder was dissolved as in the formulations (1) and (2) shown in Table 1 below to prepare liquid detergents, and kaolin turbidity of each liquid detergent was determined for compatibility of the builder with other detergent components. The results obtained are shown in Table 2 below.

Regarding the compatibility, when the kaolin turbidity is 200 mg/liter or less, the compatibility is indicated "Good", and when the kaolin turbidity exceeds 200 mg/liter, the compatibility is indicated "Poor". The builders in which the compatibility in both the formulations (1) and (2) is good are considered "good" to any liquid detergent.

The kaolin turbidity was determined as follows.

The respective components were thoroughly stirred to prepare a uniform solution, followed by degassing. The turbidity at 25° C. of the resulting solution was measured with NDH2000 (turbidimeter), manufactured by Nippon Denshoku K.K. The kaolin turbidity thus measured is expressed in terms of "mg/liter".

The numerical data indicating the amount of each component in Tables 1 and 3 are mass % in terms of the solid content of the active ingredient. In Tables 1 and 3, Neopelex F-65 is sodium dodecylbenzenesulfonate having a purity of about 65%, manufactured by Kao Corporation; SFT-70H is Softanol 70H, manufactured by Nippon Shokubai Co., which is polyoxyethylene alkyl ether; and Cortamine 86W is stearyltrimethylammonium chloride having a purity of about 28%, manufactured by Kao Corporation.

TABLE 1

| | Liquid Detergent Formulation (1) | Liquid Detergent Formulation (2) |
|---|---|---|
| Neopelex F-65 | 46 | 23 |
| SFT-70H | 8 | 4 |
| Cortamine 86W | 7.1 | 3.6 |
| Ethanol | 15 | 7.5 |
| Propylene Glycol | 5 | 2.5 |
| Liquid detergent builder | 1 | 1 |
| Water | Balance | Balance |
| Total | 100 | 100 |

TABLE 2

| | Polymer | | Calcium Ion-Binding Capacity | Clay | Compatibility | |
|---|---|---|---|---|---|---|
| Sample | Composition | Mass ratio | mg $CaCO_3$/g | Dispersibility | (1) | (2) |
| Example 1-1 | Copolymer 1 alone | 100 | 384 | 0.09 | Good | Good |
| Example 1-2 | Copolymer 2 alone | 100 | 335 | 0.24 | Good | Good |
| Example 1-3 | Copolymer 3 alone | 100 | 346 | 0.45 | Good | Good |
| Example 1-4 | Copolymer 1/ polymer 1 | 90/10 | 359 | 0.28 | Good | Good |

TABLE 2-continued

| Sample | Polymer Composition | Polymer Mass ratio | Calcium Ion-Binding Capacity mg $CaCO_3$/g | Clay Dispersibility | Compatibility (1) | Compatibility (2) |
|---|---|---|---|---|---|---|
| Example 1-5 | Copolymer 1/ polymer 1 | 80/20 | 344 | 0.35 | Good | Good |
| Example 1-6 | Copolymer 3/ polymer 1 | 90/10 | 327 | 0.48 | Good | Good |
| Example 1-7 | Copolymer 1/ copolymer 4 | 80/20 | 325 | 0.15 | Good | Good |
| Example 1-8 | Copolymer 3/ copolymer 4 | 90/10 | 313 | 0.43 | Good | Good |
| Comparative Example 1-1 | Copolymer 5 alone | 100 | 440 | 0.03 | Poor | Poor |
| Comparative Example 1-2 | Copolymer 6 alone | 100 | 421 | 0.02 | Poor | Good |
| Comparative Example 1-3 | Polymer 1 alone | 100 | 243 | 0.43 | Good | Poor |

It is confirmed from the above results that the liquid detergent builders and the liquid detergents, containing copolymer 1 of the present invention all have excellent calcium ion-binding capacity, clay dispersibility in high hardness water and compatibility.

High hardness water as referred to herein is water that is prepared under a predetermined condition as described in the above Examples. Specifically, 0.3 g of clay, JIS test powder I, class 11 (Kanto loam, fine particles), available from the Association of Powder Process Industry and Engineering, Japan, was added to water in a test tube or the like under a specific condition to prepare high hardness water having a calcium concentration of 200 ppm in terms of calcium carbonate.

Example 2-1

Copolymer 4 alone was used as a liquid detergent builder.

Example 2-2

The same builder as used in Example 1-7 was used.

Example 2-3

The same builder as used in Example 1-8 was used.

Comparative Example 2-1

The same builder as used in Comparative Example 1-3 was used.

The calcium ion-binding capacity and the clay dispersibility in high hardness water of the liquid detergent builders of Examples 2-1 to 2-3 and Comparative Example 2-1 were determined. In addition, 1 mass % of each builder was dissolved as in the formulation (3) shown in Table 3 below to prepare liquid detergents, and the compatibility of each liquid detergent was determined in the same manner as above. The results obtained are shown in Table 4.

TABLE 3

| | Liquid Detergent Formulation (3) |
|---|---|
| Neopelex F-65 | 20 |
| SFT-70H | 6 |
| Cortamine 86W | 3.6 |
| Ethanol | 2.5 |
| Propylene Glycol | 7.5 |
| Liquid detergent builder | 1 |
| Water | Balance |
| Total | 100 |

TABLE 4

| Sample | Polymer Composition | Polymer Mass ratio | Calcium Ion-Binding Capacity mg $CaCO_3$/g | Clay Dispersibility | Compatibility (3) |
|---|---|---|---|---|---|
| Example 2-1 | Copolymer 4 alone | 100 | 141 | 0.44 | Good |
| Example 2-2 | Copolymer 4/ copolymer 1 | 20/80 | 325 | 0.15 | Good |
| Example 2-3 | Copolymer 4/ copolymer 3 | 10/90 | 313 | 0.43 | Good |
| Comparative Example 2-1 | Polymer 1 alone | 100 | 243 | 0.43 | Poor |

It is confirmed from the above results that the liquid detergent builders and the liquid detergents, containing copolymer 4 of the present invention all have excellent calcium ion-binding capacity, clay dispersibility in high hardness water and compatibility.

Example 3-1

1 mass % of polymer 2 was dissolved as in the liquid detergent formulations (4) and (5) shown in Table 5 below to prepare liquid detergents.

Example 3-2

1 mass % of polymer 3 was dissolved as in the liquid detergent formulations (4) and (5) shown in Table 5 below to prepare liquid detergents.

Comparative Example 3-1

1 mass % of polymer 4 was dissolved as in the liquid detergent formulations (4) and (5) shown in Table 5 below to prepare liquid detergents.

The calcium ion-binding capacity, clay dispersibility in high hardness water and compatibility of the liquid detergents of Examples 3-1 and 3-2 and Comparative Example 3-1 above were determined in the same manner as above. The results obtained are shown in Table 6.

In Table 5, Emal 270J is sodium polyoxyethylene-lauryl-ether sulfate having a purity of about 70%, manufactured by Kao Corporation.

TABLE 5

| | Liquid Detergent Formulation (4) | Liquid Detergent Formulation (5) |
|---|---|---|
| Neopelex F-65 | 25 | 8.3 |
| Emal 270J | — | 31 |
| SFT-70H | 8.8 | 2.7 |
| Ethanol | 3.2 | 4.2 |
| Propylene Glycol | 9.4 | 7.5 |
| Polymer | 1 | 1 |
| Water | Balance | Balance |
| Total | 100 | 100 |

TABLE 6

| | Polymer | | Calcium Ion-Binding Capacity | Clay | Compatibility | |
|---|---|---|---|---|---|---|
| Sample | Composition | Mass ratio | mg $CaCO_3$/g | Dispersibility | (4) | (5) |
| Example 3-1 | Polymer 2 alone | 100 | 190 | 1.05 | Good | Good |
| Example 3-2 | Polymer 3 alone | 100 | 220 | 1.24 | Good | Good |
| Comparative. Example 3-1 | Polymer 4 alone | 100 | 240 | 1.09 | Poor | Poor |

It is confirmed from the above results that the polymers of the present invention and the liquid detergents containing the polymer all have excellent calcium ion-binding capacity, clay dispersibility in high hardness water and compatibility.

Example 4-1

1 mass % of copolymer 7 was dissolved as in the liquid detergent formulation (6) shown in Table 7 below to prepare a liquid detergent.

Comparative Example 4-1

1 mass % of copolymer 8 was dissolved as in the liquid detergent formulation (6) shown in Table 7 below to prepare a liquid detergent.

The calcium ion-binding capacity and clay dispersibility in high hardness water of the copolymers of Example 4-1 and Comparative Example 4-1 above, and the compatibility of the liquid detergents were determined in the same manner as above. The results obtained are shown in Table 8.

TABLE 7

| | Liquid Detergent Formulation (6) |
|---|---|
| Neopelex F-65 | 46 |
| SFT-70H | 10 |
| Ethanol | 5 |
| Propylene Glycol | 10 |
| Copolymer | 1 |
| Water | Balance |
| Total | 100 |

TABLE 8

| Sample | Polymer Composition | Polymer Mass ratio | Calcium Ion-Binding Capacity Mg $CaCO_3$/g | Clay Dispersibility | Compatibility (6) |
|---|---|---|---|---|---|
| Example 4-1 | Copolymer 7 alone | 100 | 200 | 0.19 | Good |
| Comparative Example 4-1 | Copolymer 8 alone | 100 | 270 | 0.45 | Poor |

It is confirmed from the above results that the polymer of the present invention and the liquid detergent containing the polymer both have excellent calcium ion-binding capacity, clay dispersibility in high hardness water and compatibility.

INDUSTRIAL APPLICABILITY

The liquid detergent builder according to the present invention comprising an acrylic acid/maleic acid-based copolymer (salt) or an acrylic acid/HAPS-based copolymer (salt), each having a specific composition and a specific molecular weight, and the acrylic acid-based polymer (salt) according to the present invention have extremely good calcium ion-binding capacity and clay dispersibility in high hardness water. When those are used in liquid detergents, their compatibility with a surfactant is excellent. As a result, the liquid detergents containing the builder or the polymer exhibit extremely excellent detergency not only in low hardness water but also in high hardness water.

The invention claimed is:

1. A liquid detergent, comprising:

an acrylic acid/maleic acid-based copolymer (salt), wherein the acrylic acid/maleic acid-based copolymer (salt) contains maleic acid (salt) in an amount of 5-90 mol% per mole of the sum of acrylic acid (salt) and maleic acid (salt), and a product (MA×Mw) of a weight average molecular weight (Mw) of the copolymer (salt) and a proportion (MA (mol%)) of the maleic acid (salt) in the copolymer (salt) is 450,000 or less; and a surfactant, wherein the liquid detergent is transparent, has a water content of 1.5 to 50 mass% and a kaolin turbidity of 200 mg/liter or less, and wherein the surfactant is present in an amount of 10-60 mass%, based on the mass of the liquid detergent.

2. The liquid detergent as claimed in claim 1, wherein the acrylic acid/maleic acid-based copolymer (salt) has a calcium ion-binding capacity of 280 mg $CaCO_3$/g or more.

3. The liquid detergent as claimed in claim 1 or 2, wherein the acrylic acid/maleic acid-based copolymer (salt) has a clay dispersibility in high hardness water of 0.30 or more.

4. A liquid detergent, comprising a liquid detergent builder, wherein the liquid detergent builder comprises an acrylic acid/HAPS-based copolymer (salt), wherein the acrylic acid/HAPS-based copolymer (salt) contains HAPS (salt) in an amount of 1-50 mol% per mole of the sum of acrylic acid (salt) and HAPS (salt), and has a weight average molecular weight of 100,000 or less, and wherein the liquid detergent is transparent.

5. The liquid detergent as claimed in claim 4, wherein the acrylic acid/HAPS-based copolymer (salt) has a calcium ion-binding capacity of 120 mg $CaCO_3$/g or more.

6. The liquid detergent as claimed in claim 4 or 5, wherein the acrylic acid/HAPS-based copolymer (salt) has a clay dispersibility in high hardness water of 0.30 or more.

7. The liquid detergent as claimed in claim 1, wherein the acrylic acid/maleic acid-based copolymer (salt) has a weight average molecular weight Mw of 500-4,500, and the liquid detergent comprises 0.5 mass% or more of the acrylic acid/maleic acid-based copolymer (salt).

8. The liquid detergent as claimed in claim 1, wherein the acrylic acid/maleic acid-based copolymer (salt) further comprises at least one member selected from fumaric acid (salt) and methacrylic acid (salt) as a comonomer.

9. The liquid detergent as claimed in claim 1, wherein the acrylic acid/maleic acid-based copolymer (salt) has a clay dispersibility in high hardness water of 0.5 or more.

10. The liquid detergent as claimed in claim 1, wherein the acrylic acid/maleic acid-based copolymer (salt) has a calcium ion-binding capacity of 150 mg $CaCO_3$/g or more.

11. The liquid detergent as claimed in claim 1, wherein the surfactant is present in an amount of 15-50 mass%, based on the mass of the liquid detergent.

12. The liquid detergent as claimed in claim 1, wherein the surfactant is present in an amount of 20-45 mass%, based on the mass of the liquid detergent.

13. The liquid detergent as claimed in claim 1, wherein the surfactant is present in an amount of 25-40 mass%, based on the mass of the liquid detergent.

14. The liquid detergent as claimed in claim 1, wherein the surfactant comprises an anionic surfactant and a nonionic surfactant, and the total amount of the anionic surfactant and the nonionic surfactant is 50 mass% or more, based on the mass of all the surfactants.

15. The liquid detergent as claimed in claim 14, wherein the anionic surfactant comprises at least one member selected from the group consisting of salts of alkylbenzenesulfonic acids and salts of alkyl or alkenyl ether sulfuric acids.

16. The liquid detergent as claimed in claim 14, wherein the nonionic surfactant comprises at least one member selected from the group consisting of polyoxyalkylene alkyl or alkenyl ethers.

17. A liquid detergent comprising 0.5 mass% or more of a liquid detergent builder which comprises an acrylic acid-based polymer (salt) having a weight average molecular weight Mw of 500-4,500; and a surfactant in an amount of 10-60 mass%, based on the mass of the liquid detergent, wherein the liqiud detergent is transparent, has a water content of 1.5 to 50 mass% and a kaolin turbidity of 200 mg/liter of less.

18. The liguid detergent as claimed in claim 17, wherein the acrylic acid-based polymer (salt) comprises at least one member selected from maleic acid (salt), fumaric acid (salt) and methacrylic acid (salt) as a comonomer.

19. The liquid detergent as claimed in claim 17 or 18, wherein the acrylic acid-based polymer (salt) has a clay dispersiblity in high hardness water of 0.5 or more.

20. The liquid detergent as claimed in any one of claims 17 to 18, wherein the acrylic acid-based polymer (salt) has a calcium ion-binding capacity of 150 mg $CaCO_3$/g or more.

21. The liqiud detergent as claimed in claim 19, wherein the acrylic acid-based polymer (salt) has a calcium ion-binding capacity of 150 mg $CaCO_3$/g or more.

22. The liquid detergent as claimed in claim 17, wherein the acrylic acid-based polymer (salt) has a terminal sulfonic acid group.

* * * * *